United States Patent [19]

Kanemitsu

[11] 4,455,853

[45] * Jun. 26, 1984

[54] METHOD OF MAKING POLY-V PULLEYS

[75] Inventor: Yukio Kanemitsu, Hyogo, Japan

[73] Assignee: Goshi Kaisha Kanemitsu Doko Yosetsu-sho, Japan

[ * ] Notice: The portion of the term of this patent subsequent to Feb. 2, 1999 has been disclaimed.

[21] Appl. No.: 328,929

[22] Filed: Dec. 9, 1981

[30] Foreign Application Priority Data

Dec. 27, 1980 [JP] Japan ..... 55-189161

[51] Int. Cl.[3] ..... B21H 1/00

[52] U.S. Cl. ..... 72/84; 29/159 R

[58] Field of Search ..... 72/82, 83, 84, 85, 106, 72/102, 108; 29/159 R, 159.1

[56] References Cited

U.S. PATENT DOCUMENTS

| | | | |
|---|---|---|---|
| D. 266,982 | 11/1982 | Kanemitsu | D8/360 |
| D. 266,983 | 11/1982 | Kanemitsu | D8/360 |
| D. 266,984 | 11/1982 | Kanemitsu | D8/360 |
| D. 267,472 | 1/1983 | Kanemitsu | D8/360 |
| D. 267,540 | 11/1982 | Kanemitsu | D8/360 |
| D. 267,541 | 1/1983 | Kanemitsu | D8/360 |
| D. 268,092 | 3/1983 | Kanemitsu | D8/360 |
| 2,139,833 | 12/1938 | Le Jeune et al. | 29/159.1 |
| 2,471,906 | 5/1949 | Smith | 74/230.3 |
| 2,787,914 | 4/1957 | Nelson | 74/230.8 |
| 2,878,551 | 3/1959 | Woodward | 29/159.1 |
| 3,368,376 | 2/1968 | Previte | 72/82 |
| 3,457,751 | 7/1969 | Lindeman | 72/105 |
| 3,722,309 | 3/1973 | Shaffer | 74/230.8 |
| 3,772,928 | 11/1973 | Gobeille | 74/230.7 |
| 3,838,485 | 10/1974 | Oldford | 29/159 R |
| 3,907,371 | 9/1975 | Luedi | 29/159.1 |
| 3,945,102 | 3/1976 | Kotlar | 29/159 R |
| 3,953,995 | 5/1976 | Haswell et al. | 72/84 |
| 3,962,926 | 6/1976 | Kotlar | 74/230.8 |
| 3,977,264 | 8/1976 | Sproul | 74/230.8 |
| 3,994,181 | 11/1976 | Sproul | 74/230.8 |
| 4,050,321 | 9/1977 | Kraft | 74/230.8 |
| 4,078,410 | 3/1978 | Lemmo | 72/82 |
| 4,080,704 | 3/1978 | Blakesley | 29/159 R |
| 4,083,215 | 4/1978 | Guetzlaff | 72/82 |
| 4,086,798 | 5/1978 | Lemmo | 72/82 |
| 4,197,756 | 4/1980 | Yaros | 74/230.3 |
| 4,273,547 | 6/1981 | Bytzek | 474/170 |
| 4,313,323 | 2/1982 | Kanemitsu | 72/84 |

OTHER PUBLICATIONS

Italian Pat. 508,176, dated 1/55, (Ghirelli).

German Offenlegungsschrift 28 22 056, dated 11/79, (Mittermeier).

*Primary Examiner*—Lowell A. Larson

*Attorney, Agent, or Firm*—Steele, Gould & Fried

[57] ABSTRACT

Improvements in a method of making a poly-V pulley from a metal plate which has V-shaped poly-V grooves formed in a cylindrical flange wall of a cup-shaped blank, by the application of pressing, compression and finishing processes to the blank. More particularly, the improvements reside in the compression process in which the opening end of the flange wall of a cup-shaped blank is fittingly held by a fitting groove which is formed in an upper peripheral edge of a lower rotary pressing form, the groove having a slope with a predetermined upward inclination in the radially inward direction toward the center of the form. Auxiliary rollers are pressed into groove valleys of the corrugated wall of the blank, and the blank is then axially compressed while rotating the blank, thereby converting the corrugated wall into a grooved wall having therein a series of V-shaped crests and valleys.

1 Claim, 17 Drawing Figures

METHOD OF MAKING POLY-V PULLEYS

BACKGROUND OF THE INVENTION

1. Field of the Invention

The present invention relates to improvements in a method of making a poly-V pulley from a metal plate, and more particularly to an improvement in a compression process in a poly-V pulley making method capable of forming a grooved wall having even or regular pitch between the groove valleys without any distortion.

2. Description of the Prior Art

Recently, various kinds of poly-V pulleys have been developed to be used for poly-V belts instead of V-pulleys conventionally well known. The pulleys have in their outer surfaces a plurality of narrow V-grooves along the belt travelling direction.

U.S. Pat. No. 3,977,264 (Nolte V. Sproul) discloses a technique of making a poly-V pulley made of a metal plate. However, this disclosure teaches only a basic principle of making poly-V pulleys; pressing, compression and finishing processes are applied to a cylindrical flange wall of a cup-shaped blank to form sharp V-shaped poly-grooves (poly-V grooves), thereby making a poly-V pulley.

According to such poly-V pulley making method, the compression process is specially important since high accuracy is required for the V-grooves formed in the flange wall of the cup-shaped blank. It is therefore not too much to say that the compression process determines the quality of a poly-V pulley manufactured. In other words, it is very difficult from a technical point of view to form corrugations in the flange wall of a cup-shaped blank, which is folded in a zigzag manner to form a grooved wall having an even or regular pitch between groove valleys in the compression process, prior to the step of finishing in which sharp V-shaped grooves are formed in the flange wall. That is, in a pre-forming process prior to compression process, a cup-shaped blank is pre-molded to have a gently corrugated flange wall provided with a series of round valleys and crests, it seldom happens that crests and valleys of the corrugation are regularly bent at the compression process in which the cup-shaped blank is compressed while rotating upper and lower rotary pressing forms with an auxiliary roller pressed into each of the valleys. Accordingly, they are unevenly or irregularly bent in most cases.

If the flange wall is bent out of shape in such manner, the pitch between valleys formed on the groove wall becomes uneven or irregular, thus making the subsequent finishing process difficult. It will be easily expected that, in the extreme case, a pulley thus manufactured would be rejected as defective. In addition, if the flange wall is irregularly bent out of shape to form uneven or irregular corrugation in the inner and outer circumferential surfaces of the flange wall, the convex and concave portions of the flange wall bite the outer circumference of the inner form disposed inside the cup-shaped blank, thus making it difficult to pull off the cup-shaped blank from the inner form, which gives rise to trouble in view of manufacturing efficiency.

As apparent from the foregoing, among the poly-V pulley manufacturing processes, the compression process is regarded as a process in which trouble may arise most easily. In the art, therefore, improvements in the compression process have been strongly desired and various proposals are made, often through the process of repeated trial and error.

SUMMARY OF THE INVENTION

This invention is based on the discovery that if the opening end edge of a flange wall of a cup-shaped blank is firstly bent regularly with a predetermined inclination, the aforementioned problems in the poly-V compression process are effectively overcome.

It is therefore an object of the present invention to provide a method of making a poly-V pulley capable of properly providing a bending deformation of a flange wall of a cup-shaped blank in the compression process, forming V-grooves having an even or regular pitch without any distortion, and preventing the flange wall opening edge from undesirably bending outwardly.

Another object of the present invention is to provide a method of making a poly-V pulley capable of more smoothly performing the finishing process after the compression process, thereby improving the productivity.

In order to achieve these objects, the poly-V pulley making method in accordance with the present invention includes a compression process in which, with the opening end edge of a flange wall of a cup-shaped blank fittingly held by a fitting groove which is formed in the upper peripheral edge of a lower rotary pressing form, the groove having a flank and an engagement slope with a predetermined inclination, the blank is axially compressed with auxiliary rollers pressed into valleys in the corrugated wall formed in the flange wall, thereby forming a grooved wall having V-shaped crests and valleys with even or regular pitch.

Other objects, advantages and features of the present invention will become more apparent from the following detailed description of the invention by reference to the accompanying drawings illustrative of the preferred embodiments of the invention.

BRIEF DESCRIPTION OF THE DRAWINGS

A detailed description of the invention will be made with reference to the accompanying drawings, wherein.

DETAILED DESCRIPTION OF THE PREFERRED EMBODIMENTS

Figure 1:
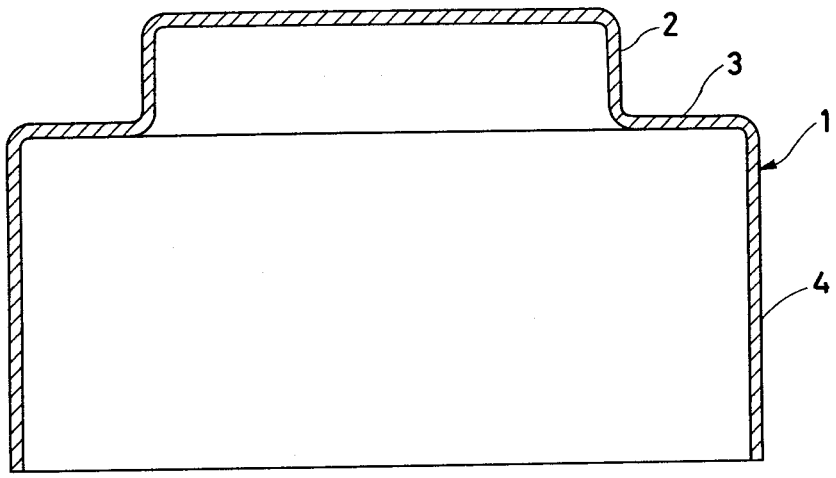
FIG. 1 is a longitudinal section view of a cup-shaped blank before being pre-formed.

The description hereinafter will discuss an outline of the present invention in order to facilitate understanding on the present invention, before making a detailed discussion thereof with reference to the accompanying drawings.

As discussed earlier, the present invention comprises the steps of pre-forming the flange wall of a cup-shaped blank so as to form a gently corrugated wall, axially compressing the corrugated wall of the cup-shaped blank while rotating the cup-shaped blank with auxiliary forming rollers pressed to the corrugated wall, thereby converting the corrugated wall into a grooved wall regularly having a series of V-shaped crests and valleys, and finishing the grooved wall of the cup-shaped blank, while rotating the cup-shaped blank with a finishing roller pressed into the valleys in the grooved wall, thereby forming sharp V-shaped poly-grooves in the grooved wall. Particular improvements are made in the compression process to overcome the defects of the prior art. A poly-V pulley thus manufactured is designated 5 in FIG. 4, such poly-V pulley 5 being used with the respective V-grooves 7 thereof engaging with projecting portions 9 of a poly-V belt 8.

The description hereinafter will then be made in detail of the steps constituting the method of the present invention.

Figure 2:
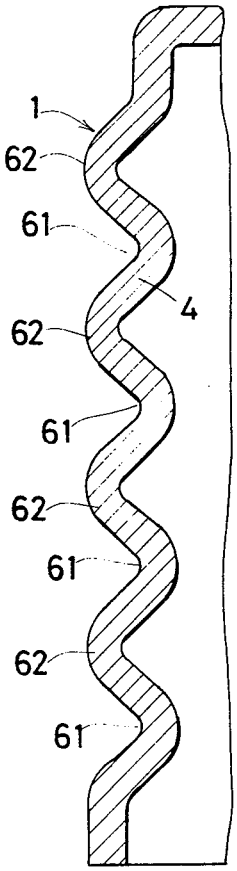
FIG. 2 is a longitudinal section view of a portion of the pre-formed flange wall of the cup-shaped blank.
Figure 3:
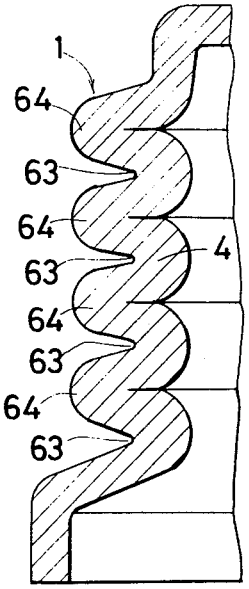
FIG. 3 is a longitudinal section view of a portion of the compressed flange wall of the cup-shaped blank.
Figure 5:
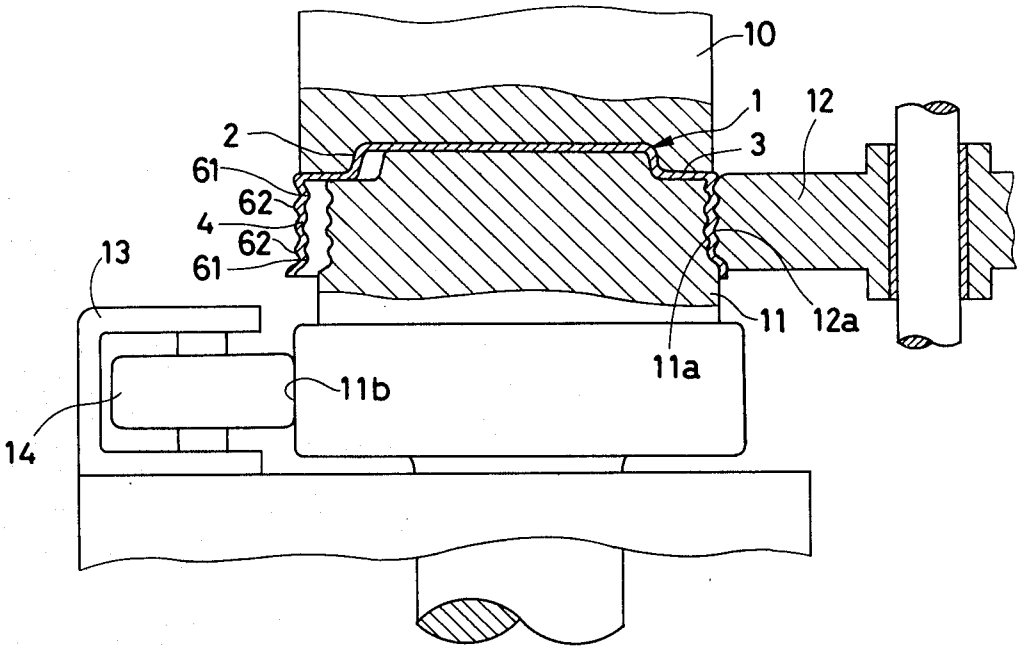
FIGS. 5 and 6 are views showing a procedure of the pre-forming process, FIG. 5 illustrating how to form a corrugated wall in a flange wall of the cup-shaped blank with the use of a pre-forming roller, and FIG. 6 being a schematic plan view of FIG. 5.
Figure 6:
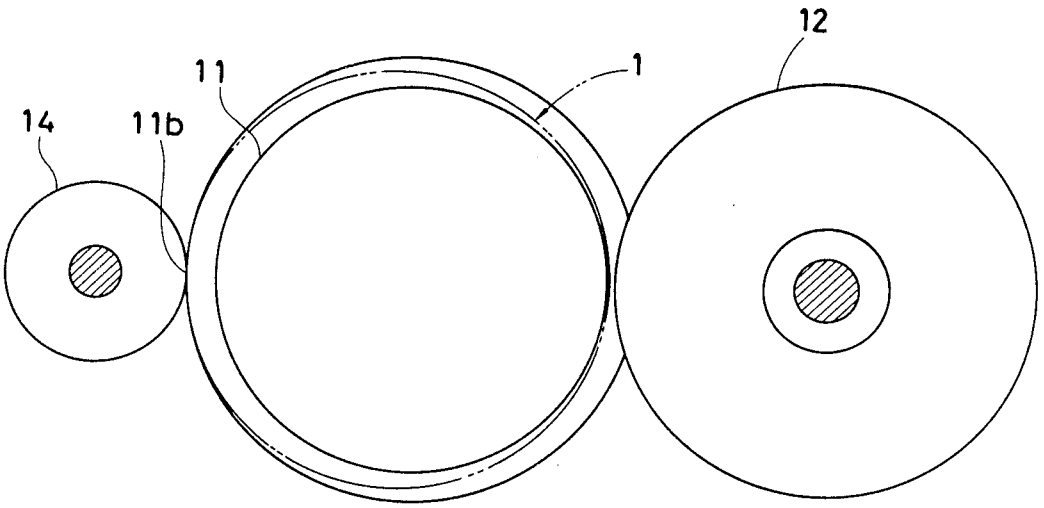

According to the pre-forming process, a cup-shaped blank 1 shown in FIG. 1 and formed from a metal plate by stamping or the like, is supported between a pair of upper and lower rotary supporting forms 10 and 11 as shown in FIGS. 5 and 6, and is kept rotating around the center axis while the inner and outer circumferential surfaces of a flange wall 4 of the cup-shaped blank 1 are pressingly held by and between a portion of the outer circumference of the lower rotary supporting form 11 having gentle concave and convex portions, and the outer circumference of a preforming roller 12 having concave and convex portions corresponding to the concave and convex portions in the circumference of the supporting form 11. The basic principle of this forming step is known. Namely, a corrugated wall having a series of round valleys 61 and crests 62 as shown in FIG. 2 is made in such a way that the lower rotary supporting form 11 having an outer diameter smaller than the inner diameter of the flange wall 4 of the cup-shaped blank 1 is eccentrically rotated, and upon each rotation of the supporting form 11, a portion or rolling face 11*a* of the outer circumferential surface of the supporting form 11 comes in contact with the inner circumferential surface of the flange wall 4, thereby to pressingly hold and deform the outer and inner circumferential surfaces of the flange wall 4 between and by the rolling face 12*a* of the pre-forming roller 12. It is to be noted at this process that there is disposed a rotatable pressing roller 14 of which shaft is attached to a fixed frame 13. The roller 14 is disposed in contact with the lateral side 11*b* of the lower rotary supporting form 11 opposite to the eccentric direction or opposite to the pre-forming roller 12. Such arrangement prevents the lower rotary supporting form 11 from being bent or deformed due to a uni-directional external force exerted by the pre-forming roller 12 during the pre-forming process.

Figure 7:
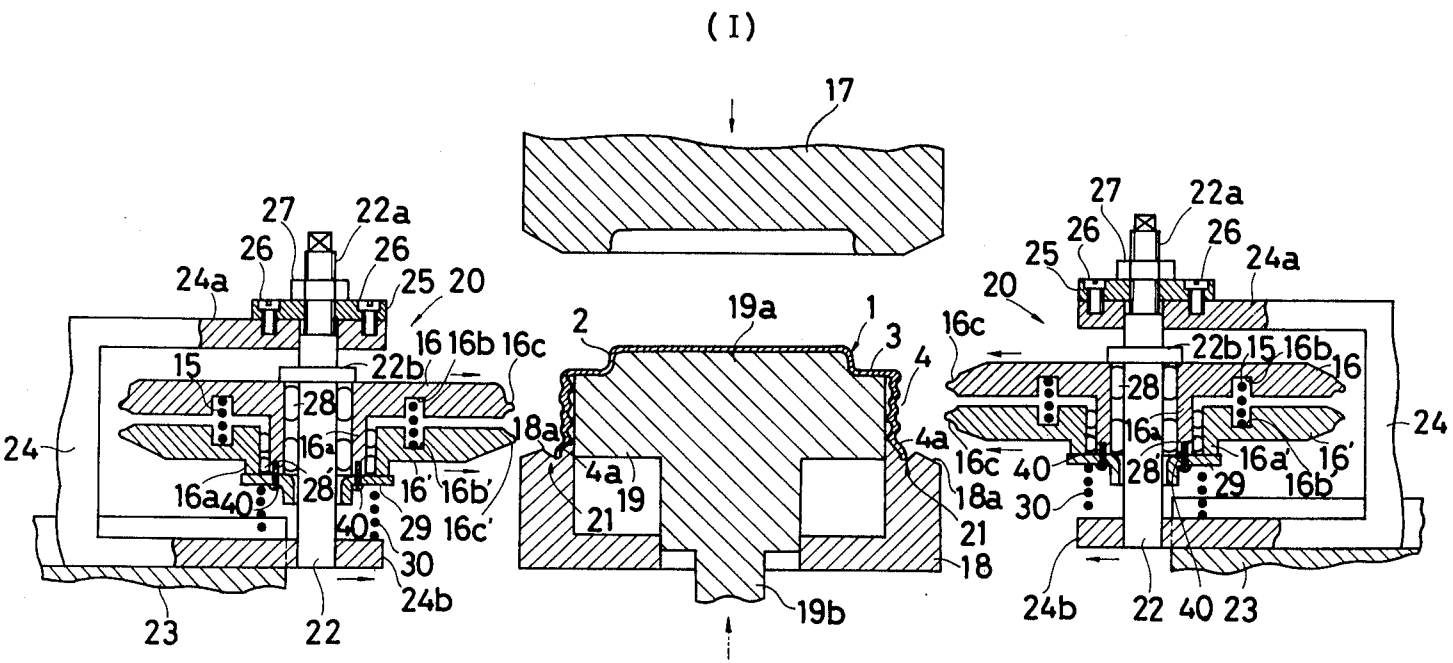
FIGS. 7 (I) to (IV) are views showing respective stages of the compression process.
Figure 7:
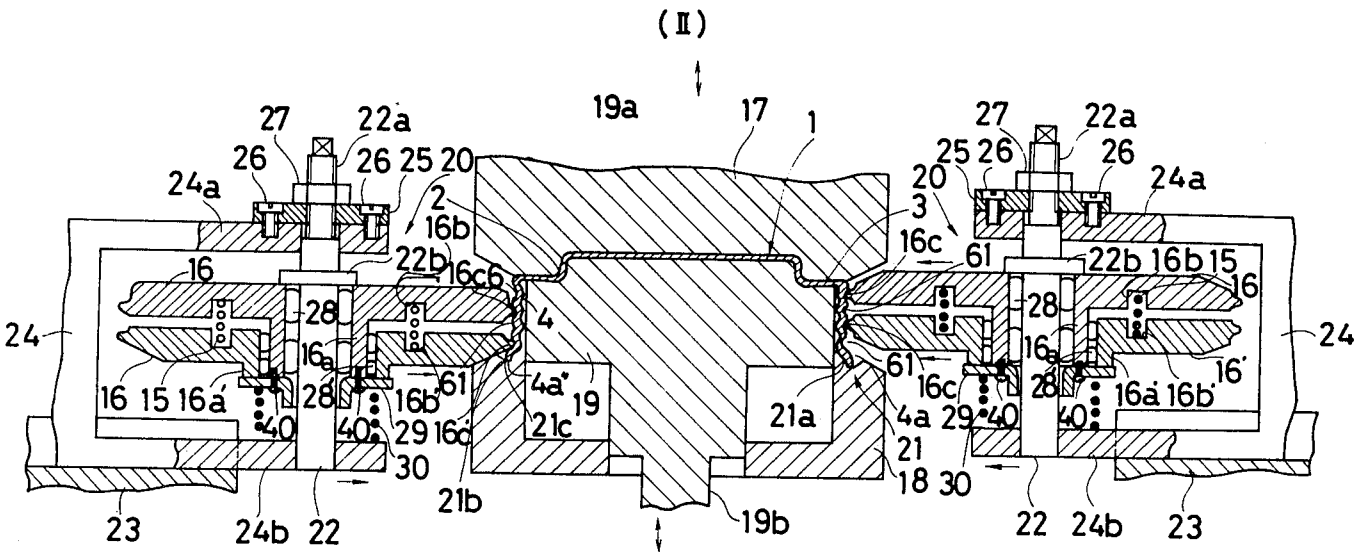
Figure 7:
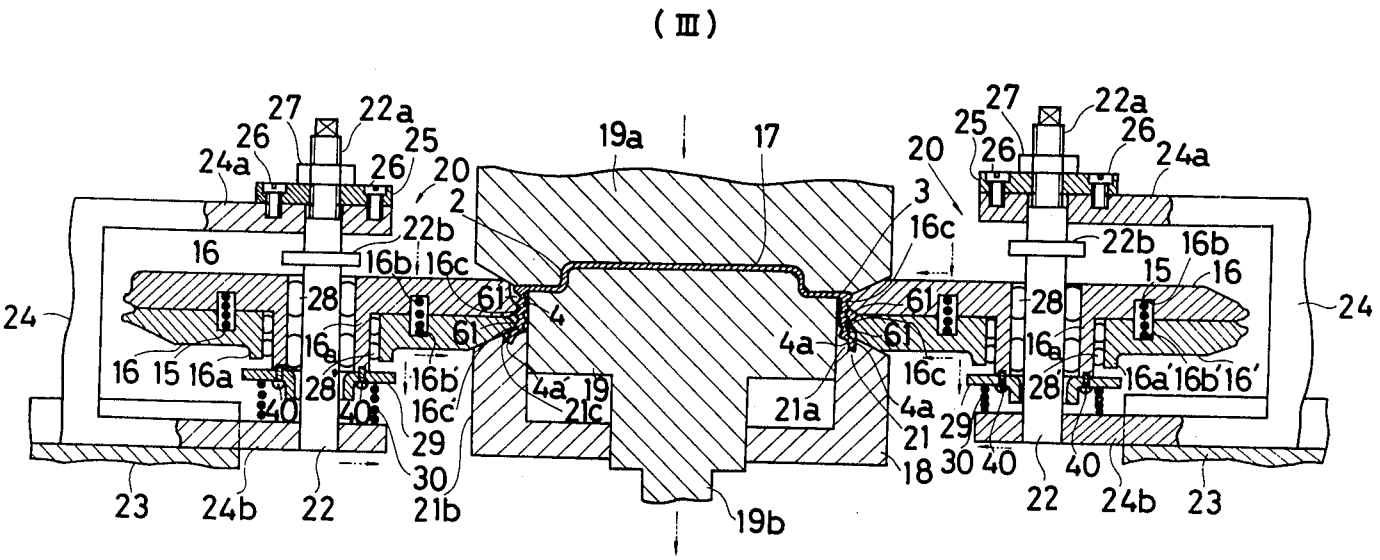
Figure 7:
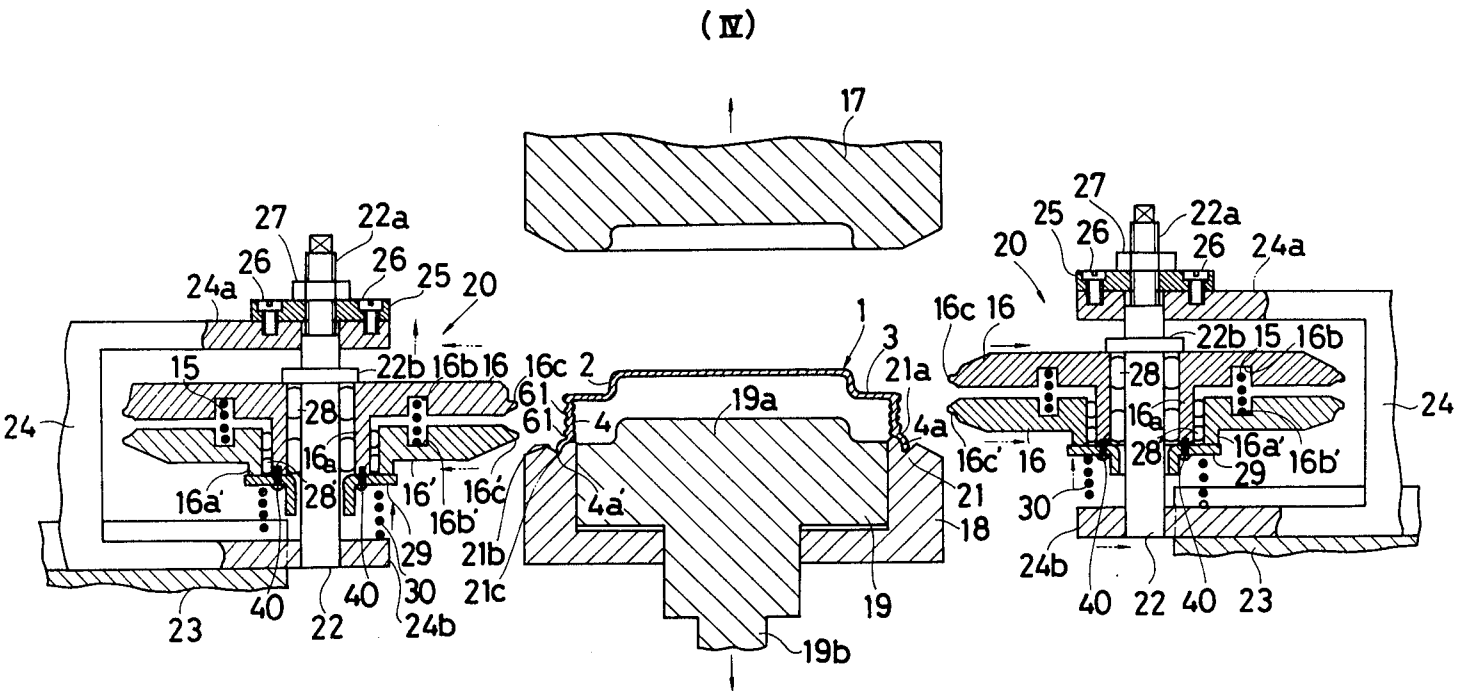

The compression process is performed according to the stages shown in FIGS. 7 (I) to (IV). In order to facilitate understanding on this process, the description hereinafter will discuss first the equipment to perform such process.

In FIGS. 7 (I) to (IV), a rotary pressing form 17 to be vertically movable is adapted, at the compression process, to cover the top surface of the cup-shaped blank 1 and apply a vertical force to the cup-shaped blank 1 from above, thereby to press the same. A substantially cylindrical lower rotary pressing form 18 has an open top and a closed bottom and houses therein a vertically movable lower rotary receiving form 19. The pressing form 18 indispensable in that the form 18 holds the opening end 4*a* of the cup-shaped blank 1 during the compression process, thereby to prevent the opening end 4*a* being undesirably bent during the compression process.

Figure 8:
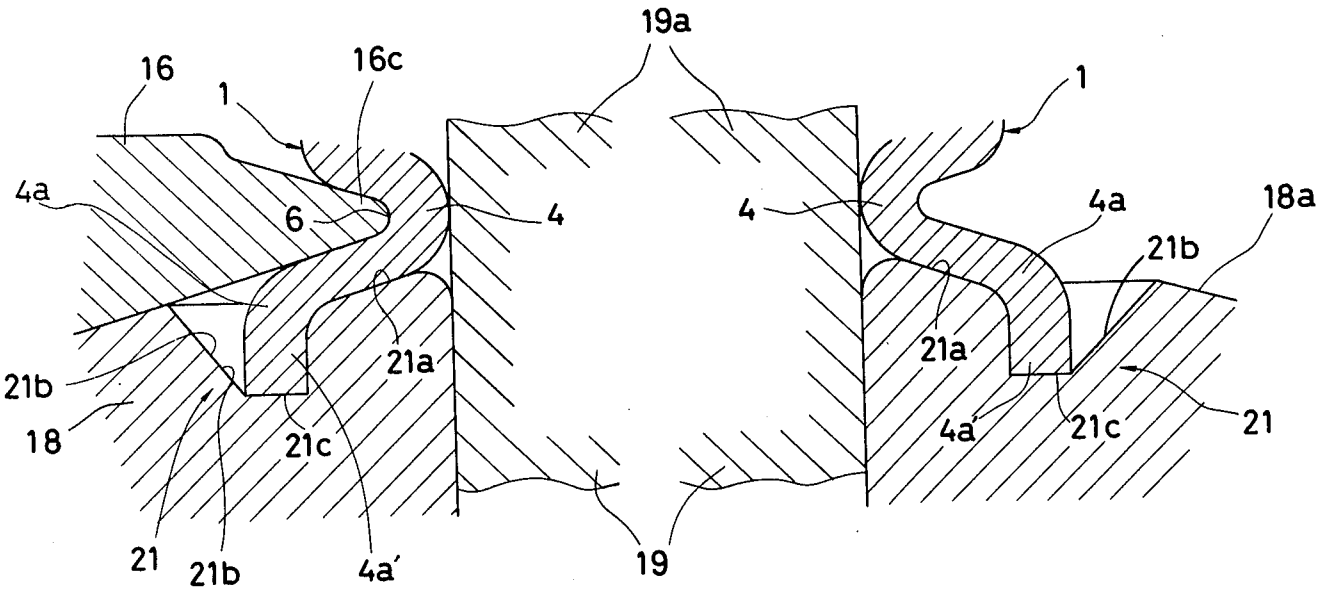
FIG. 8 is an enlarged schematic section view of the opening end of the cup-shaped blank at the compression process.

The lower rotary pressing form 18 has an upper edge 18*a* of a relatively large width. As best shown in FIG. 8, the upper edge 18*a* is provided in the periphery thereof with a fitting groove 21 which includes an inner wall having an engagement slope 21*a* with a predetermined upward inclination in the radially inward direction toward the center of the rotary pressing form 18, an outer wall having a flank 21*b* with a predetermined upward inclination in the radially outward direction from the center of the form 18, and a flat groove bottom 21*c*.

The groove bottom 21*c* of the fitting groove 21 is adapted to engagingly receive the opening end 4*a*' of the cup shaped blank 1, so that the opening end 4*a* can be advantageously prevented from being unnecessarily expanded outwardly at the time of the compression process. The engagement slope 21*a* of the inner wall is indispensable for setting an initial bending angle of the opening and 4*a* at the time the flange wall 4 is compressed such that V-grooves can be formed in the flange wall 4 at the compression process without any distortion with even or regular pitch between the groove valleys. The flank 21*b* of the outer wall advantageously prevents the opening end 4*a*' of the flange wall 4 from bending outwardly during the compression process. In addition, the flank 21*b* provides an increased open area of the fitting groove 21, thus facilitating removal of the cup-shaped blank after the compression process. The receiving form 19 for supporting the cup-shaped blank 1 has a circular head 19*a* for supporting the cup portion 2 of the cup-shaped blank 1 so as to prevent the cup-shaped blank 1 from being undesirably deformed during the compression process. The receiving form 19 is adapted to be rotatably driven together with the lower rotary pressing form 18 around a drive shaft 19*b* at the time of the compression process.

Auxiliary forming roller devices 20 are disposed at the lateral sides with respect to the lower rotary receiving form 19 and have the same structure. These devices 20 are disposed at the opposite positions at the lateral sides with respect to the lower rotary pressing form 18 and have support shafts 22 in parallel with the upper and lower rotary pressing forms 17 and 18. A pair of auxiliary forming rollers 16 and 16' are rotatably attached to each of the support shafts 22. The auxiliary forming rollers 16 and 16' have pointed rolling faces 16*c* and 16*c*', respectively, which approximately correspond to each of finished V-grooves formed in the flange wall 4 of the cup-shaped blank 1. The rollers 16 and 16' also have bosses 16a and 16a', respectively, which have different diameters. The support shafts 22 pass through the upper auxiliary rollers 16 with bearings 28 disposed between the support shafts 22 and the bosses 16a having a smaller diameter. Bearings 28' are disposed between the outer periphery of the bosses 16a of the upper auxiliary rollers 16 and the bosses 16a' having a larger diameter of the lower auxiliary rollers 16'. The upper and lower auxiliary forming rollers 16 and 16' have spring means 15 in annular grooves 16b and 16b' formed in the facing inner sides of the rollers 16 and 16'. These spring means 15 apply spring load to the rollers 16 and 16' such that they are separated from each other. The spring means 15 shown in this embodiment are different from those constituted by a plurality of independent springs to apply a resilient spring load to the upper and lower auxiliary rollers in the roller separating direction. In other words, even if the rotating speeds of the upper and lower auxiliary rollers 16 and 16' are different, such spring means 15 are not twisted but can always apply a perfect spring load to the rollers 16 and 16', so that the distance between the upper and lower auxiliary rollers can be smoothly reduced with the advance of the compression of the cup-shaped blank.

Each of the support shafts 22 is held between an upper arm 24a and a lower arm 24b of a holding member 24 telescopically supported by a fixed frame 23. Each of the support shafts 22 has a threaded portion 22a at its upper end which projects from the upper arm 24a. A holding plate 25 threadedly mounted to this threaded portion 22a is fixed to the upper arm 24a with set screws 26. A nut 27 is threadedly mounted to the threaded portion 22a projecting from the holding plate 25 thereby to fix the support shaft 22 to the upper arm 24a. Accordingly, by loosening the nuts 27 and rotating the support shafts 22 with respect to the holding plates 25, the positions of the support shafts 22 can be set with respect to the upper and lower arms 24a and 24b. The peripheral edges of the bosses 16a of the upper auxiliary rollers 16 are fixed to flange means 29 idly mounted to the support shafts 22, with screws 40. With such arrangement, the auxiliary rollers 16 are securely fixed to the flange means 29. Coil springs 30 are disposed between the flange means 29 and the lower arms 24b of the roller devices 20.

According to such arrangement, the upper and lower auxiliary rollers 16 and 16' of each roller device 20 not only rotate independently around the support shaft 22, but also slowly descend as the spring 30 is compressed with the advance of the compression of the flange wall of the cup-shaped blank 1. In addition, the distance between the rollers 16 and 16' is not reduced suddenly but is reduced gradually because of presence of the spring means 15. It is thus understood that the roller devices 20 perform ideally during the process of compressing the cup-shaped blank 1.

The compression process in accordance with the present invention is performed by using in cooperation the devices above-mentioned under predetermined conditions.

The description hereinafter will discuss the respective stages of the compression process.

As shown in FIG. 7 (I), with the receiving form 19 held at the lifted position, a pre-formed cup-shaped blank 1 is set between the upper and lower rotary pressing forms 17 and 18. It is important at this time to properly engage the opening edge 4a of the flange wall 4 of the cup-shaped blank 1, with the groove bottom 21c of the fitting groove 21 in the lower rotary pressing form 18 as shown in FIG. 8. The levels of the auxiliary rollers 16 and 16' of each auxiliary forming roller device 20 are set such that the rollers 16 and 16' are properly pressed into the valleys of the grooved wall formed in flange wall 4 of the cup-shaped blank 1. Thus, the initial position of the compression process is set. As shown in FIG. 7 (II), the upper rotary pressing form 17 is then lowered and placed on the cup portion 2 and the stepped portion 3 of the cup-shaped blank 1. While rotating the receiving form 19 and the upper and lower rotary pressing forms 17 and 18 in the same direction, the flange wall 4 of the cup-shaped blank 1 is axially compressed by the upper and lower rotary pressing forms 17 and 18. With the advance of such compression, the receiving form 19 is gradually lowered as shown in FIG. 7 (III). Since the distance between the upper and lower auxiliary forming rollers 16 and 16' of each auxiliary forming roller device 20 is maintained constant by a resilient force of the spring means 15, such distance can be smoothly reduced without any strain with the advance of the compression of the flange wall 4 of the cup-shaped blank 1.

By such compression process, the corrugated wall formed in the flange wall of the cup-shaped blank 1 is gradually changed. The bending of the flange wall 4 can proceed properly, since the flange wall 4 is compressed with the opening edge 4a of the flange wall 4 of the cup-shaped blank 1 fittingly held by the fitting groove 21 having the engagement slope 21a to determine the bending angle of the opening edge 4a of the flange wall 4 and the flank 21b to prevent the opening edge 4a from bending outwardly. Accordingly, the corrugated wall formed in the flange wall 4 is free from undesired distortion and has a regular or even corrugation defined by the rolling faces 16c and 16c' of the auxiliary rollers 16 and 16', so that sharp crests 64 and thickened V-shaped valleys 63 are evenly or regularly formed with a predetermined pitch.

Figure 4:
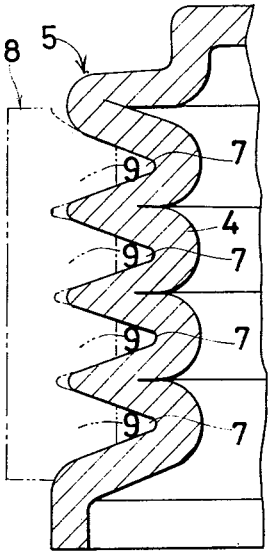
FIG. 4 is a longitudinal section view of a portion of the finished flange wall of the cup-shaped blank.
Figure 9:
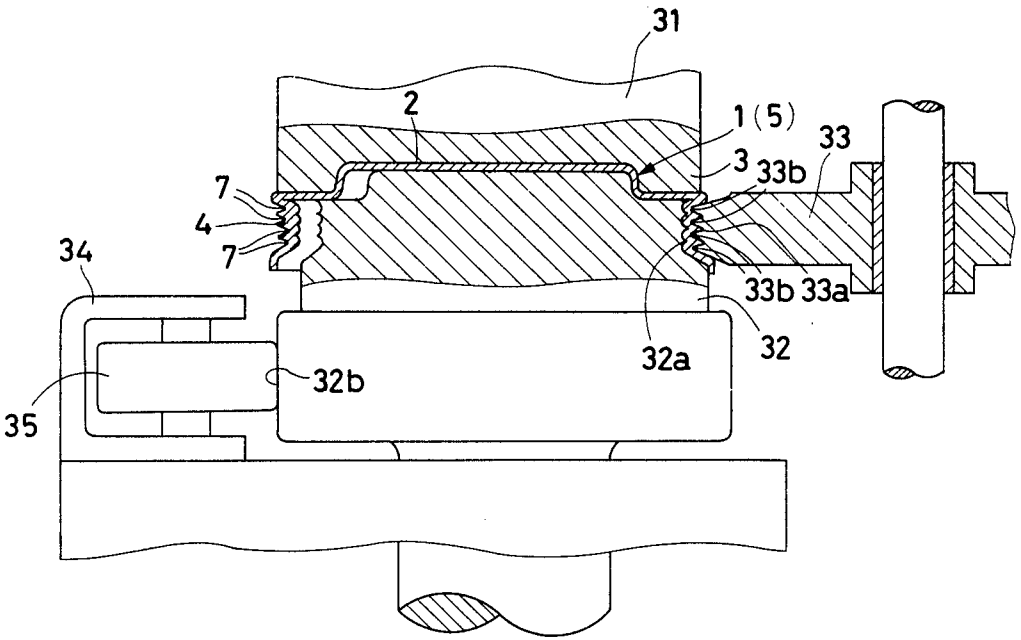
FIGS. 9 and 10 are views showing a finishing process, FIG. 9 illustrating how to roll the V-groove wall formed in the flange wall of the cup-shaped blank, with the use of a finishing roller to form sharp poly-V grooves and FIG. 10 being a schematic plan view of FIG. 9; and, FIGS. 11 to 13 are views showing another embodiment of the present invention, FIG. 11 being a partial section view illustrating the pre-forming process, FIGS. 12 (A) and (B) being partial section views illustrating the compression process, and FIG. 13 being a partial section view illustrating the finishing process.
Figure 10:
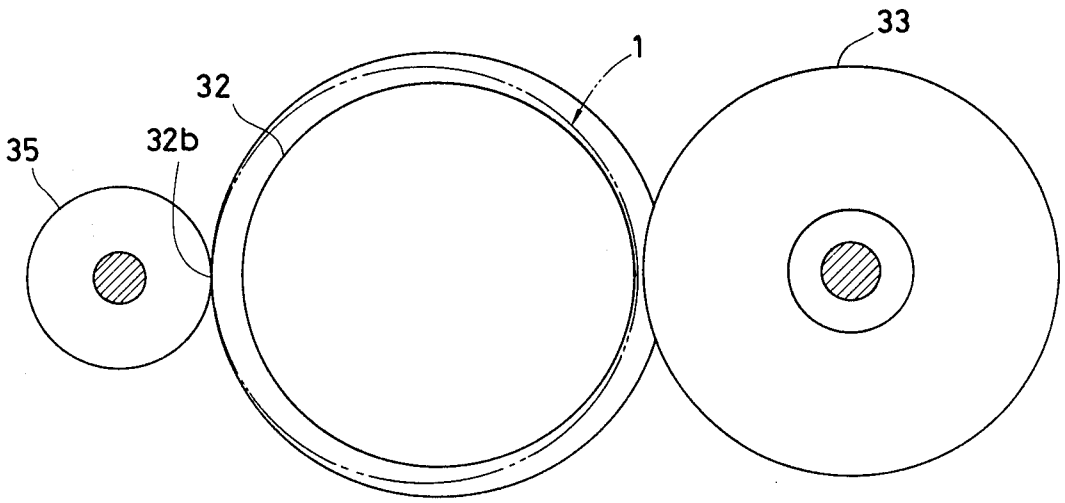

At the final finishing process, as shown in FIG. 9 a finishing roller 33 having sharp V-shaped rolling faces 33b is pressed to the valleys of the grooved wall of the cup-shaped blank 1 formed at the compression process above-mentioned, while eccentrically rotating a receiving form 32 having concave and convex portions corresponding to the concave and convex portions in the inner circumferential surface of the cup-shaped blank 1. Thus, the grooved wall of the cup-shaped blank 1 is rolled in the same manner as that of the pre-forming process. It is not necessary to discuss the detail of such finishing process. After the completion of the finishing process, the cup-shaped blank 1 will be formed into a poly-V pulley as shown in FIG. 4.

Figure 11:
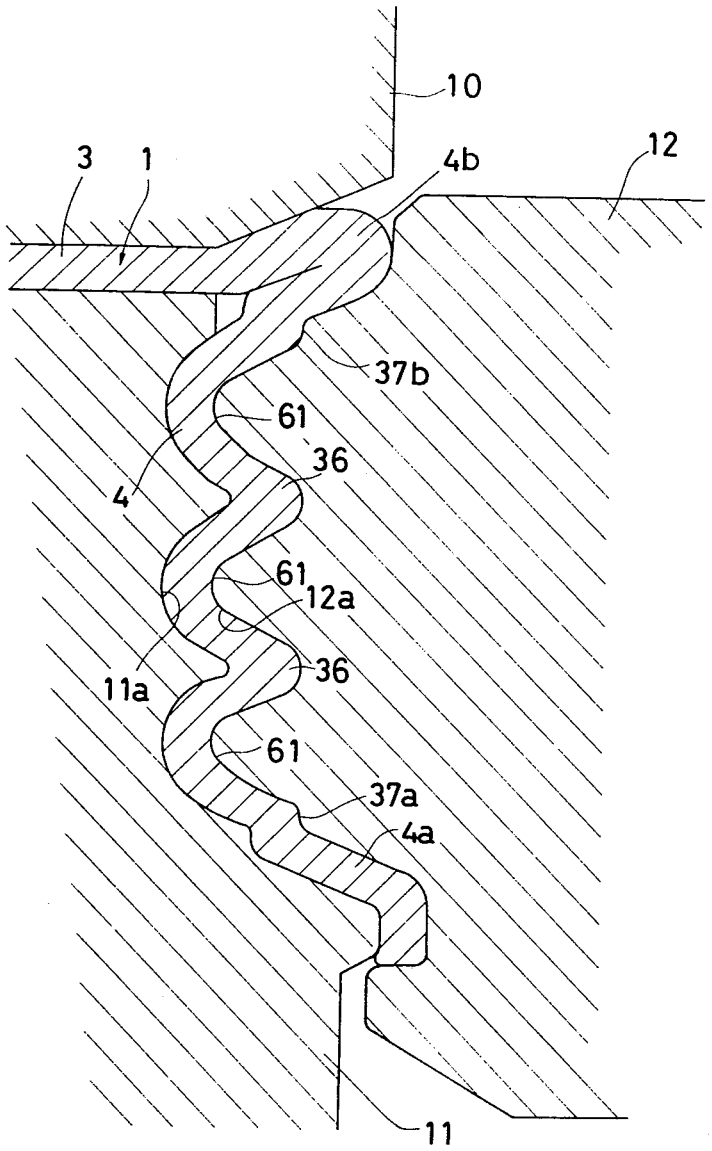
Figure 12:
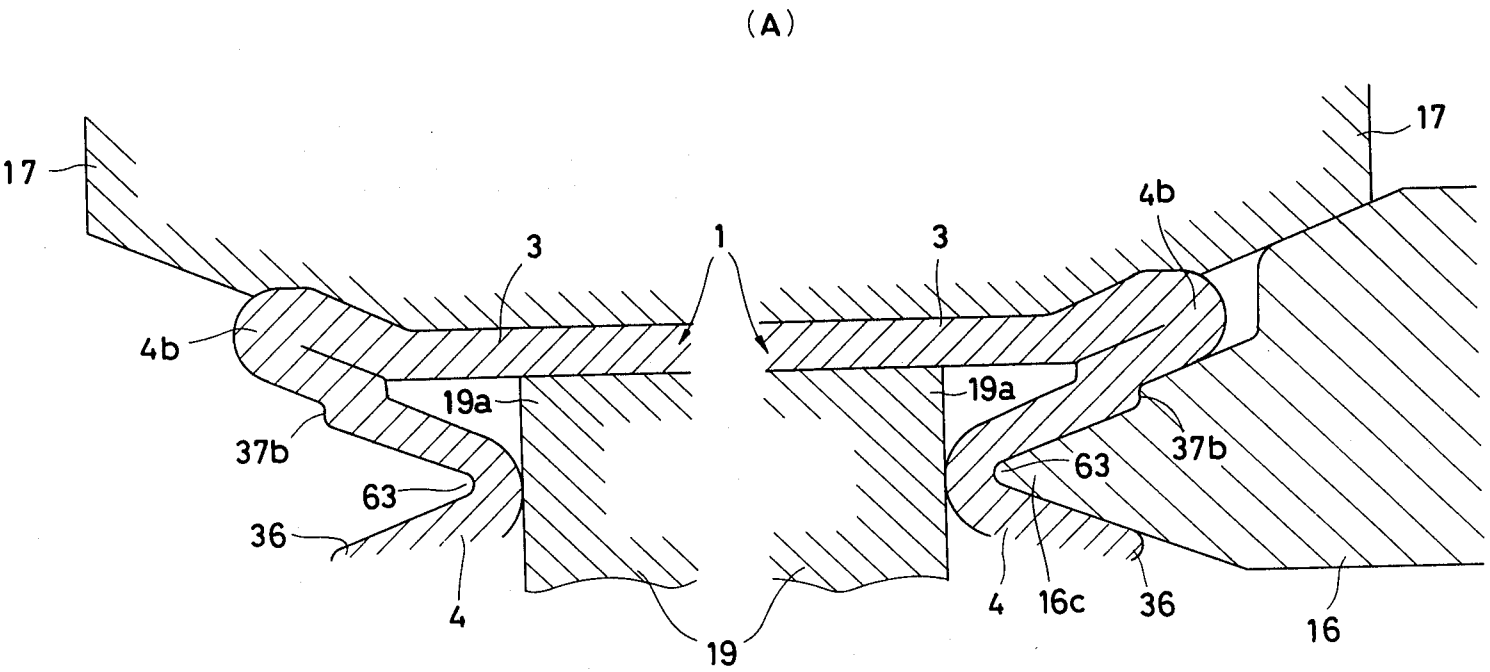
Figure 12:
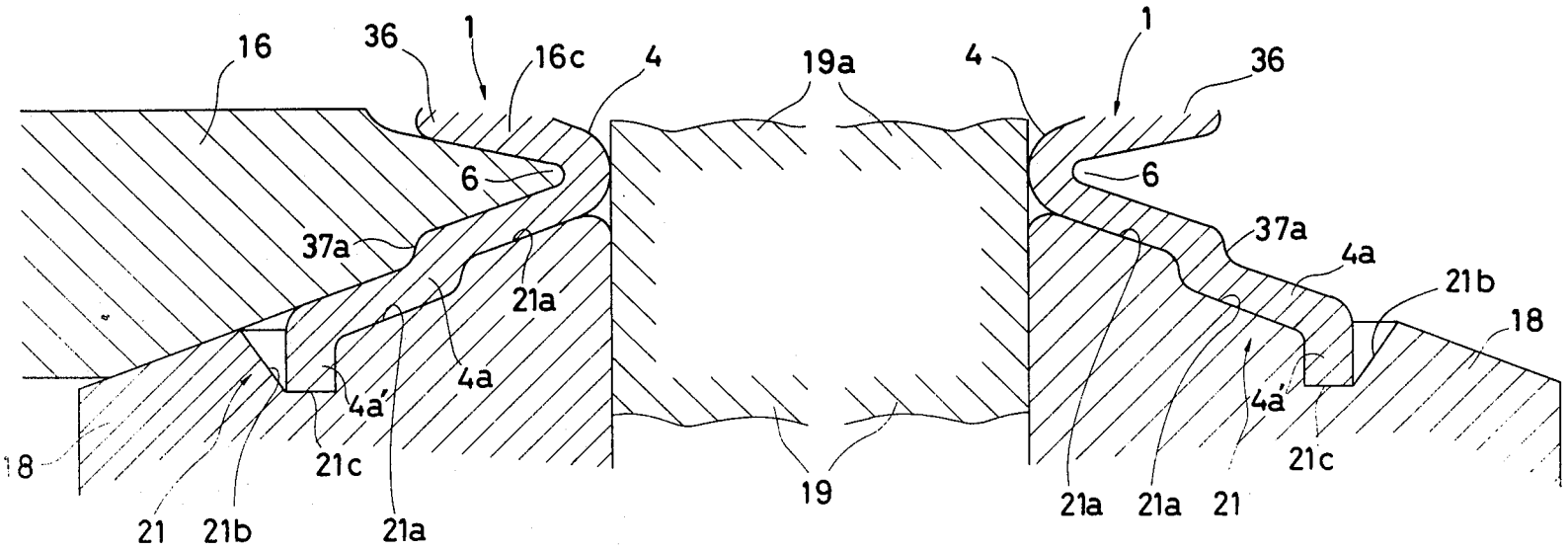
Figure 13:
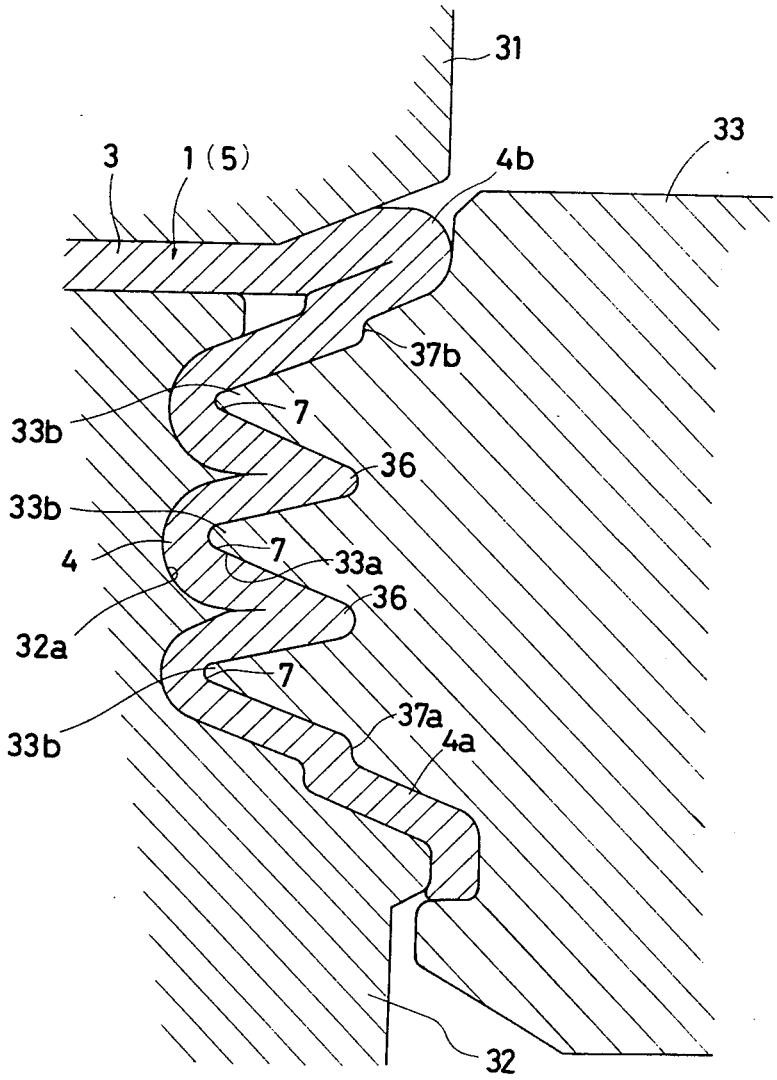

FIGS. 11 to 13 show another embodiment of the present invention. Such embodiment is an example in which the present invention is applied to a method of making a poly-V pulley made of a metallic plate in which the lower and upper end edges 4a and 4b of the flange wall 4 of the cup-shaped blank 1 are made higher than the crests 36 thereof and stepped portions 37a and 37b are formed in the flange wall 4 at the substantially same height as that of the crests 36, these stepped portions 37a and 37b being formed in the direction away from each other. FIG. 11 illustrates the state of the flange wall 4 at the pre-forming process with the use of the preforming roller 12. FIGS. 12 (A) and (B) illustrate the states of the upper and lower edges of the flange wall at the compression process with the use of the auxiliary forming rollers 16 and 16'. FIG. 13 illustrates how the finishing rolling process is made with the use of a finishing forming roller 33. It is to be noted that like parts in FIGS. 11 to 13 are designated by like numerals used in FIGS. 1 to 10.

In the embodiments discussed hereinbefore, a pair of upper and lower rollers have been disposed as auxiliary forming rollers to be used during the compression process. However, the present invention can also be embodied with the use of a set of three or more vertically arranged rollers as auxiliary forming rollers with spring means disposed between adjacent auxiliary forming rollers, thereby to apply a resilient force to the auxiliary rollers such that they are separated from each other. It is to be noted here that such spring means are wound in the rotation direction.

The shapes of the end edge of the flange wall 4 of the poly-V pulley 5 made according to the present invention are not limited to those shown in the embodiments discussed hereinbefore, but can be variously changed.

With the description made hereinbefore, the present invention can be fully understood. It will be apparent to those skilled in the art that the equipment disclosed in the Detailed Description of the Invention is discussed only by way of example for embodying the present invention and various similar equipment may be used for embodying the present invention.

What is claimed is:

1. A method for making poly-V pulleys, comprising the steps of:

pre-forming a cup-shaped blank, having a cylindrical flange wall and an opening end flange wall edge, by pressingly deforming the inner and outer circumferential surfaces of said flange wall, thereby forming a corrugated wall having a series of round valleys and crests around the outer circumference of said flange wall;

compressing said pre-formed flange wall of said cup-shaped blank by vertically moving a pair of upper and lower rotary pressing forms which pressingly support said cup-shaped blank therebetween, and while rotating said pair of pressing forms, pressing auxiliary rollers into the valleys of said corrugated wall of said cup-shaped blank, thereby forming said corrugated wall of said cup-shaped blank into a V-grooved wall having a series of sharp crests and valleys, the opening end edge of the flange wall tending to become misshapen;

during said forming, preventing the opening end edge of said pre-formed flange wall from becoming misshapen, during the compressing and rotating, by retaining the opening edge in a flat bottom portion of a fitting groove formed in the upper peripheral edge of said lower rotary pressing form;

during said forming, controlling the angle of inclination assumed by the portion of the flange wall forming the lowest V-groove during the compressing and rotating, by bending said portion of the flange wall against an engagement slope formed around the inner circumference of the fitting groove, the engagement slope having a predetermined upward inclination in the radially inward direction toward the axis of said pressing forms;

during said forming, preventing the opening end edge from bending radially outwardly during the compressing and rotating, by surrounding the outer circumference of the fitting groove with a flank having a predetermined upward inclination in the radially outward direction from the axis of said pressing forms; and, finishing said V-grooved wall of said cup-shaped blank by rotating said cup-shaped blank while radially pressing a finishing roller into the valleys of said groove wall formed during the compressing and rotating, thereby forming sharply defined and evenly spaced poly-V grooves in the flange wall.

* * * * *